US005421172A

United States Patent [19]

Jones

[11] Patent Number: 5,421,172

[45] **Date of Patent: * Jun. 6, 1995**

[54] SOFT-SIDED COOLER

[76] Inventor: Charles E. Jones, 7052 Paseo Encantada, Camarillo, Calif. 93012

[ * ] Notice: The portion of the term of this patent subsequent to Jun. 8, 2010 has been disclaimed.

[21] Appl. No.: 776,254

[22] PCT Filed: Aug. 30, 1990

[86] PCT No.: PCT/US90/04931

§ 371 Date: Nov. 18, 1991

§ 102(e) Date: Nov. 18, 1991

[87] PCT Pub. No.: WO92/04586

PCT Pub. Date: Mar. 19, 1992

[51] Int. Cl.[6] ..... F25D 3/08

[52] U.S. Cl. ..... 62/457.5; 62/457.7; 62/530

[58] Field of Search ..... 62/530, 457.5, 457.7, 62/457.2, 372

[56] References Cited

U.S. PATENT DOCUMENTS

| | | | |
|---|---|---|---|
| 3,950,789 | 4/1976 | Konz | 2/93 |
| 4,019,346 | 4/1977 | Conklin | 62/371 |
| 4,050,264 | 9/1977 | Tanaka | 62/457.7 |
| 4,213,310 | 7/1980 | Buss | 62/457 |
| 4,249,392 | 2/1981 | Hotta | 62/457 |
| 4,344,300 | 8/1982 | Taylor | 62/457 |
| 4,375,828 | 3/1983 | Biddison | 150/2.1 |
| 4,413,481 | 11/1983 | Thomas | 62/371 |
| 4,441,336 | 4/1984 | Cannon | 62/457 |
| 4,498,312 | 2/1985 | Schlosser | 62/457 |
| 4,537,313 | 8/1985 | Workman | 206/545 |
| 4,561,262 | 12/1985 | Fredrixson | 62/62 |
| 4,745,776 | 5/1988 | Clark | 62/457 |
| 4,751,827 | 6/1988 | Villarren | 62/406 |
| 4,858,444 | 8/1989 | Scott | 62/372 |
| 4,989,418 | 2/1991 | Hewlett | 62/457.4 |
| 5,216,900 | 6/1993 | Jones | 62/457.2 |

*Primary Examiner*—Henry A. Bennett
*Assistant Examiner*—William C. Doerrler
*Attorney, Agent, or Firm*—Seldon & Scillieri

[57] ABSTRACT

A soft-sided cooler is disclosed having a pivotably fastenable lid and a coolant container dimensioned to fit snugly within the underside region of the lid as defined by a plurality of generally opposing, inwardly facing sidewalls that extend downward towards the cooler body for fastening thereto when the lid is closed. The container is retained within the underside of the lid by VELCRO fastening surfaces on the container which mate with VELCRO fastening surfaces on at least a generally opposing pair of the sidewalls.

13 Claims, 2 Drawing Sheets

SOFT-SIDED COOLER

BACKGROUND

1. Field of the Invention

This invention relates generally to portable refrigeration receptacles, and more particularly to coolers of the picnic or lunch box type.

2. Prior Art

Numerous coolers of the picnic and/or lunch box type are known in the art. Generally, the coolers include a thermally insulated body having a cavity for storing food and/or beverages, together with a lid for closing and substantially, thermally sealing the cavity. In addition, the coolers include a cooling source for keeping the cavity (together with the food and/or beverages therein) cool.

The cooling source is typically a container filled with coolant, and means are sometimes employed for accommodating the coolant container. For example, U.S. Pat. No. 4,238,934 discloses a coolant container which fits within the upper portion of the cooler's cavity. Similarly, U.S. Pat. No. 4,213,310 discloses a cooler wherein a flask of cooling material is secured to the underside of the lid with a rotating mechanical locking mechanism.

U.S. Pat. No. 4,019,340 discloses a portable cooler having a removable cover that houses a packaged refrigerant gel. In use, the cover is described as being removed from the cooler and placed in a freezer to freeze the gel, and is thereafter placed on the cooler.

U.S. Pat. No. 4,024,731 discloses a cold storage chest whose cover includes recesses for a number of re-freezable containers. The containers are held-within the cover by threaded shafts that passes through the containers and screw into threaded holes in the lid.

U.S. Pat. No. 4,375,828 discloses a portable, insulated container which includes a number of coolant modules positioned in an arch-shaped chamber at the top of the cooler. The modules are described as being mounted to the chamber wall by means of pressure-sensitive, adherent fastening material such as VELCRO strips.

As is evident, numerous configurations have been suggested for accommodating the packs of coolant medium within the cooler. It is, of course, highly desirable to position the coolant packs in a manner which does not sacrifice the storage capacity of the cooler, and by means which provide for easy installation and removal of the coolant packs.

SUMMARY OF THE DISCLOSURE

My invention is a soft-sided cooler comprising a thermally insulated body having a cavity which defines an open-ended cold storage region for holding food and/or beverages. The cooler additionally includes a lid which is pivotably fastenable to the cooler body to close the open end of the cooler's cavity. The lid has an underside region defined by a plurality of generally opposing, inwardly facing sidewalls which extend towards the body of the cooler and fasten thereto to close the cavity.

The cooler additionally comprises a coolant container for holding a cooling medium and which is sized to fit snugly within the underside region of the lid. Means employing a pressure-sensitive, adherent fastening material, such as VELCRO, are provided to releasably retain the coolant pack within the underside region of the lid. One of the fastening surfaces is affixed to each of at least two generally opposing sidewalls. Mating fastening surfaces are secured to the coolant container so as to contact, and mate with, the fastening surfaces on the sidewalls when the container is placed within the lid's underside region. Because the mating fastening surfaces are highly resistant to relative lateral movement, the coolant container is securely held within the lid's underside region regardless of the lid's position.

Because the mating fastening surfaces are relatively easily pulled apart, however, the container can be easily removed by pulling the lid's sidewalls away from the container. Thus, the container is easily removed from, and secured within, the underside region of the lid. Further, the coolant container does not occupy any of the storage space occupied by the food and/or beverages. These and other details concerning my invention will be appreciated from the following detailed description of the preferred embodiment, of which the drawing forms a part.

DETAILED DESCRIPTION OF THE DRAWINGS

DESCRIPTION OF THE PREFERRED EMBODIMENT

Figure 1:
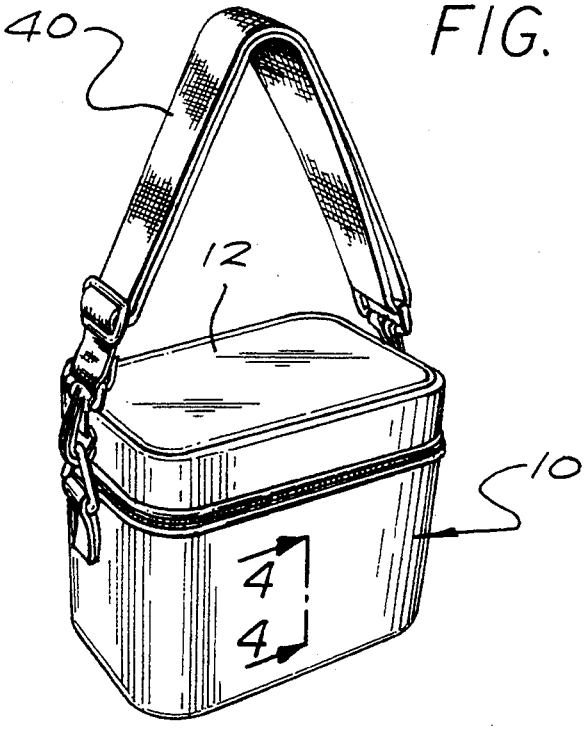
FIG. 1 is a front perspective view of a carryable, soft-sided cooler constructed in accordance with the invention.
Figure 4:
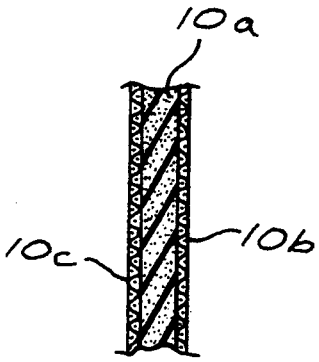
FIG. 4 is a sectional view of the cooler wall taken along line 4—4 in FIG. 1.
Figure 5:
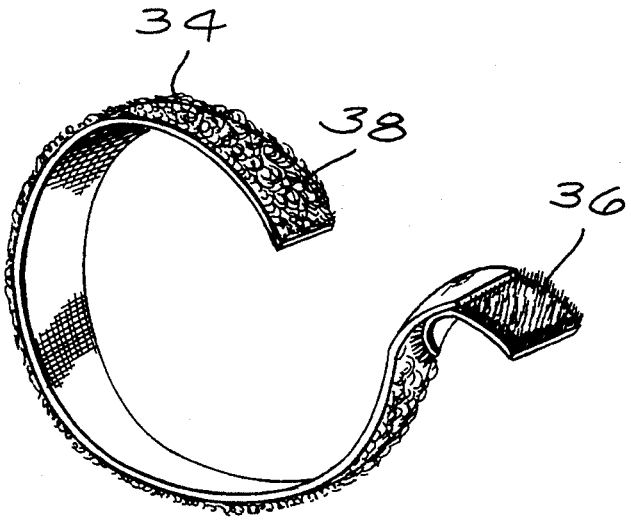
FIG. 5 illustrates a preferred VELCRO strip used in conjunction with the coolant container in FIG. 2.
Figure 3:
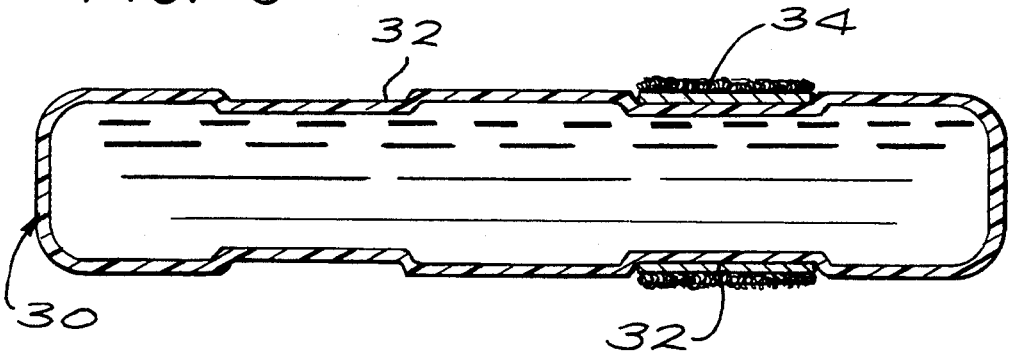
FIG. 3 is a side view in section of the coolant container of FIG. 2 taken along line 3—3.
Figure 2:
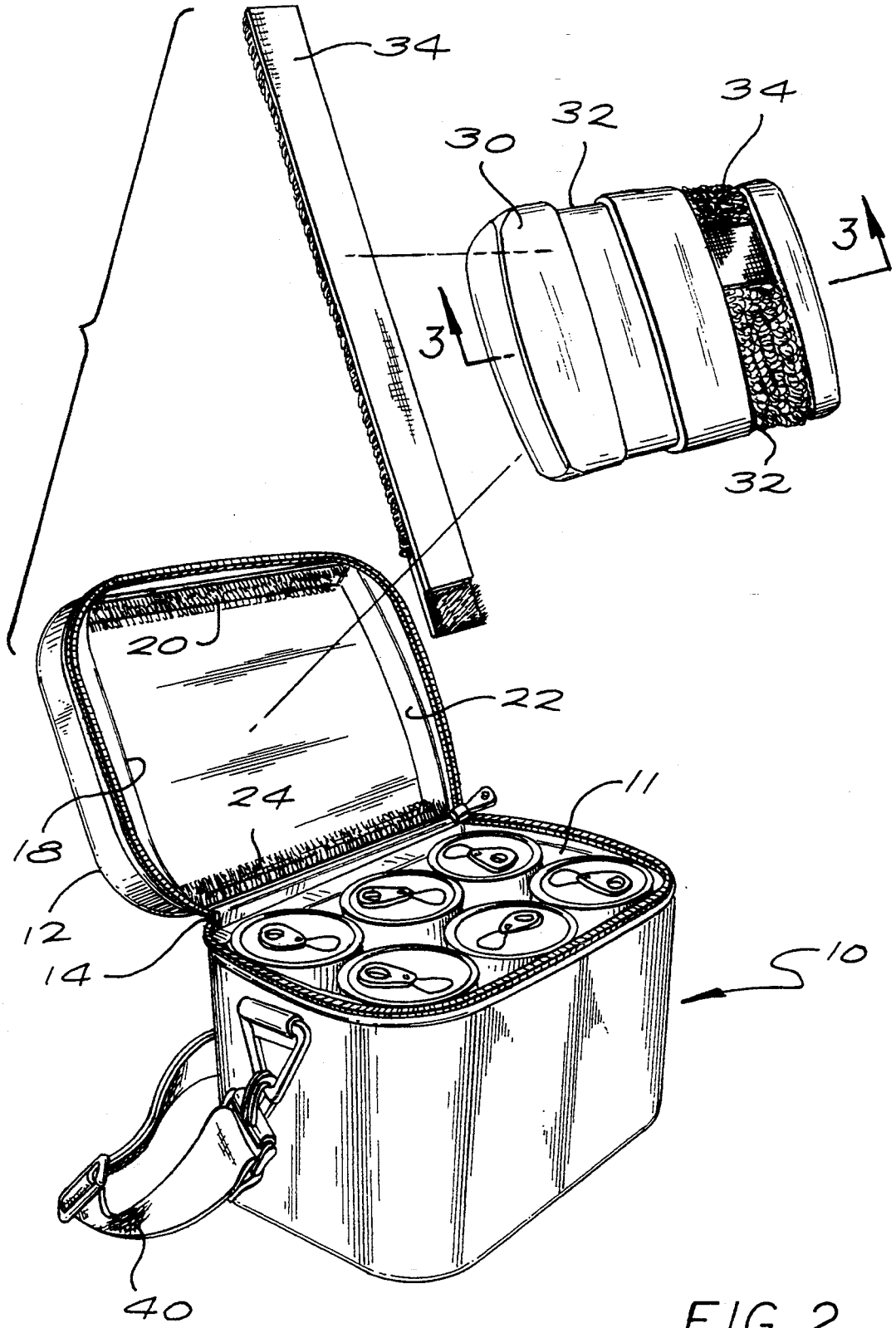
FIG. 2 is a front perspective view of the cooler of FIG. 1, with its lid open and its coolant container shown in explosion.

FIGS. 1 and 2 show a carryable, soft-sided cooler constructed in accordance with the invention. The cooler comprises a thermally insulated body 10 having a cavity 11 which defines an open-ended storage region. The storage region holds the food and/or beverages to be transported. As shown in FIG. 3, the cooler body 10 comprises a layer of thermally insulating foam **10*a* sandwiched between external layers of polyethylene, nylon or other suitable material 10*b*, 10*c*. In some cases, the cooler's cavity may be lined with a suitable fabric. Alternatively, the cooler is preferably configured to be carried as a shoulder bag, and is accordingly provided with a shoulder strap 40** that is preferably adjustable in length and removably attached to the cooler body by, for example, snaps or the illustrated hook and ring arrangement. Naturally, many other means for fastening or removably fastening the shoulder strap to the cooler body are known in the an and can be substituted.

A lid 12 is pivotably fastenable to the cooler body 10 to close the open end of the cooler's cavity 11. The lid, conveniently formed of the same material as the cooler body, is integrally joined to the body 10 along a pivot axis 14 at the rear of the cooler. Naturally, the lid could be joined at the front or either side, and need not be integrally joined to the body. In practice, the external layer of material on the cooler body is simply extended beyond the top of the cooler body to form the exterior surface of the lid, while the liner along the rear wall of the cavity is extended upward to form the interior lid surface. The interjacent insulating layer, located in the lid and in the cavity body, is omitted along the pivot axis to give the region sufficient flexibility.

The lid 12 has an underside region encompassed by four generally opposing, inwardly facing sidewalls 18, 20, 22, 24 which extend downward towards the cooler body when the lid is in the cavity-closing position. Fastening means, such as a zipper 16 are provided to releasably secure the leading downward edges of the lid's front sidewall 20, left sidewall 18 and right sidewall 22 to the cooler body's top left, top right and top front edges. The inner faces of at least two opposing sidewalls, such as the front and back sidewalls 20, 24 are lined with strips of pressure-sensitive, adherent fastening material, such as VELCRO, to secure a container filled with coolant, as described below. For the sake of simplicity, the fastening material will hereinafter be referred to as VELCRO material, although it will be recognized that any similar pressure-sensitive, adherent fastening material, will suffice so long as the surface of material is highly resistant to relative lateral movement by a mating surface of the material while permitting numerous separations of the two surfaces without substantial loss of their fastening ability.

The coolant container 30 is adapted to hold a cooling medium. The container 30 is dimensioned to fit snugly within, and occupy all of, the underside region of the lid. The container may be of the refillable type, or of the sealed but re-usable type which are both commonly known, and can be made from polypropylene, polyethylene, or some other suitable material. In accordance with the invention, the container 30 is, in either case, easily removable for freezing of the coolant, and is easily replaced in the lid subsequent to freezing to absorb heat from the cooler's cavity.

To releasably hold the container within the lid's underside region, the container is fitted with a pair of VELCRO material strips 34. Since it is relatively difficult to use a glue or adhesive to join the VELCRO strips to the container surface, the preferred embodiment simply provides for the snug fastening of the strip about the circumference of the container. Accordingly, a pair of strip-accommodating channels 32 are molded or otherwise formed in the container's exterior and extend about its circumference. The channels are sufficiently deep to permit the VELCRO surface to be generally flush with the adjacent surface of the container. The VELCRO strips, themselves, may be releasably secured to the container for easy replacement by providing means such as inter-engaging snaps or interengaging VELCRO surfaces 36, 38 at the two ends of the strip which overly each other when the strip has been placed around the circumference of the container.

The VELCRO strips are oriented about the container so that they contact the VELCRO surfaces of the sidewalls 20, 24 when the container is placed within the underside region of the lid. Because the contacting VELCRO surfaces of the container and sidewalls are highly resistant to relative lateral movement (that is, movement parallel to the plane of their surfaces), the coolant container 30 is effectively prevented from falling towards the cavity 11 when the lid is closed. Thus, the container 30 remains within the lid's underside region as the lid is opened and closed, conveniently remaining out of the way when food or beverages are put into, or taken from, the cooler. Further, the coolant container 30 occupies no space in the storage region of the cooler, and is positioned at the top of the cavity where a cooling source is most effective. Moreover, by occupying essentially the entire underside region of the lid, the quantity of coolant available for absorbing heat from the cavity and the cooler's contents is maximized.

Because the mating VELCRO surfaces are easily separated in the direction perpendicular to the plane of their surfaces, however, the container 30 can be easily removed from the lid by merely pulling the sidewall 20 or sidewall 24 of the soft-sided lid away from the container's edge and thereafter pulling the container away from the other sidewall. Re-insertion of the container is simply a matter of placing one edge of the container against one of the VELCRO-covered sidewalls so that the VELCRO bands 34 passing over the container's edge contact the VELCRO strip on the mating sidewall. The container 30 is then pivoted about its mating edge into the underside region as the opposite sidewall is held away from the opposite edge of the container, and releasing the sidewall to permit engagement between the sidewall's VELCRO strip and the bands 34.

Naturally, there are many variations and modifications which can be made without departing from the scope of my invention. For example, only a portion of the opposing, VELCRO-bearing sidewalls need to support the VELCRO surface. Additionally, any number of VELCRO strips can be used on the container, and VELCRO need only be provided at the container's edges where contact with the VELCRO-bearing sidewall is made. While the foregoing description includes detail which will enable those skilled in the art to practice the invention, it should be recognized that the description is-illustrative in nature and that many modifications and variations will be apparent to those skilled in the art having the benefit of these teachings. It is accordingly intended that the invention herein be defined solely by the claims appended hereto and that the claims be interpreted as broadly as permitted in light of the prior art.

I claim:

1. A soft-sided cooler comprising:

a thermally insulated body having a cavity defining an open-ended storage region;

a lid pivotably fastenable to said body to close the open end of the cooler cavity, the lid having an underside region defined by a plurality of generally opposing, inwardly facing sidewalls which extend downward towards the body for fastening thereto when the lid is in the cavity-closing position;

a container for holding a cooling medium and sized to fit snugly within the underside region of the lid; and VELCRO fastening means including a pair of pressure-sensitive, adherent fastening surfaces, one of the fastening surfaces being affixed to each of at least two generally opposing sidewalls, and the other of the fastening surfaces being secured to the container to contact the first surfaces so that the container is removably secured against movement into the storage region when the lid is in the cavity-closing position.

2. The cooler of claim 1 wherein the container is dimensioned to be snugly encompassed by the sidewalls.

3. The cooler of claim 1 wherein the container is dimensioned to lie essentially wholly within the underside region of the lid so as not to extend into the storage region when the lid is in the cavity-closing position.

4. The cooler of claim 1 wherein the said other fastening surface is a strip that extends along the container in a direction generally perpendicular to the length of the contacted sidewall.

5. The cooler of claim 4 wherein the container includes a strip-accommodating channel formed in its outer surface, and the strip of said other fastening surface is positioned within the channel, the channel being of an appropriate depth to permit said other fastening surface to contact said first fastening surface.

6. The cooler of claim 5 wherein the channel extends completely around the container.

7. The cooler of claim 6 wherein the strip extends completely around the container.

8. The cooler of claim 7 wherein the strip is removably tightenable about the container so that the strip can be manually removed and replaced.

9. A thermal pack for use in a portable cooler and comprising:

a container having front and rear faces and a circumscribing edge region coupling said faces, said container adapted to hold a quantity of heat absorbing material of the type which has sufficient thermal capacity to act as a cooling medium when placed in a portable cooler, the exterior of the container including a strip-accommodating channel formed therein; and a strip having an inner face and an outer face, the strip extending about the exterior of the container within the channel so as to overlie the edge regions at opposite sides of said faces with the inner face of said strip facing the exterior container surface, the outer face of said strip having a layer of pressure-sensitive, adherent fastening material along at least the portions of the strip's length which overlie the opposing edge portions.

10. The container of claim 9 wherein the channel extends completely around the container.

11. The container of claim 10 wherein the strip extends completely around the container.

12. The container of claim 9 wherein the inner face of the strip includes pressure-sensitive adherent fastening material disposed on at least one end portion whereby the strip is removably tightenable about the container so that the strip can be manually removed from the container.

13. A thermal pack for use in a portable cooler and comprising:

a container having front and rear faces and a circumscribing edge region coupling said faces, said container being adapted to hold a quantity of heat absorbing material of the type which has sufficient thermal capacity to act as a cooling medium when placed in a portable cooler, the container having a layer of pressure-sensitive, adherent fastening material along at least portions of circumferentially opposite edge portions.

* * * * *